United States Patent [19]

Duplat et al.

[11] Patent Number: 4,486,154

[45] Date of Patent: Dec. 4, 1984

[54] FUEL INJECTION PUMP

[75] Inventors: Gérard Duplat, Bron; Jean Leblanc, Lyons, both of France

[73] Assignee: Robert Bosch GmbH, Stuttgart, Fed. Rep. of Germany

[21] Appl. No.: 403,198

[22] Filed: Jul. 29, 1982

[30] Foreign Application Priority Data

Sep. 4, 1981 [DE] Fed. Rep. of Germany ..... 3135045
Nov. 25, 1981 [DE] Fed. Rep. of Germany ..... 3146625

[51] Int. Cl.[3] ..... F04B 19/22
[52] U.S. Cl. ..... 417/487; 417/462
[58] Field of Search ..... 417/460, 206, 462, 273, 417/487, 488; 123/457

[56] References Cited

U.S. PATENT DOCUMENTS 2,243,861 6/1941 Hautzenroeder ..... 123/457
3,138,103 6/1964 Dreisin et al. ..... 417/206
3,267,861 8/1966 Pigeroulet et al. ..... 417/462
3,895,886 7/1975 Leblanc ..... 417/462
4,367,714 1/1983 Di Domenico et al. ..... 417/462

FOREIGN PATENT DOCUMENTS 625280 9/1961 Italy ..... 417/462

*Primary Examiner*—William L. Freeh
*Attorney, Agent, or Firm*—Edwin E. Greigg

[57] ABSTRACT

There is proposed herein that a push rod of a fuel injection pump embodied as a radial piston pump which push rod further has a groove in its base be arranged to positively secure a roller in a relatively fixed position. The push rod is slidably guided in a hollow cylindrical wall in a sleeve. An apertured hub which forms an end wall of the sleeve has a slit, into which a prong which offstands axially from a fastening ring secured to said hub is arranged to protrude into said push rod. A helical spring supported by the sleeve presses a piston of the pump against the inside of the base of the push rod.

10 Claims, 5 Drawing Figures

FUEL INJECTION PUMP

BACKGROUND OF THE INVENTION

The invention is based on a fuel injection pump as generally described hereinafter. A pump of this kind is known from German Auslegeschrift No. 23 22 858, in which the elements effecting the stroke, such as rollers, push rods and springs, are disposed individually in the sleeve. This individual disposition is problematical, because it reduces the stability of the pump, and repair is expensive because of the great number of separate parts.

OBJECT AND SUMMARY OF THE INVENTION

With the pump according to the invention, the problem discussed above is substantially solved. The concept underlying the invention is that the push rod is guided on all sides and itself receives the other parts, in the manner of a cage.

Advantageous further embodiments of the invention are described hereinafter. For example, the functional position of the push rod is secured, and in particular it is prevented by simple means from rotating about the axis of the stroke. The fastening means required to achieve this can be manufactured in a simple manner. The functional position of the roller in the push rod is attained favorably and without additional parts. A simple and reliable orientation of the spring plate relative to the piston is thus attained.

After the end of injection, fuel is diverted from the individual stroke chambers into the interior of the pump housing until such time as the pistons have attained top dead center of the cam. It has been found that the fuel streams, exiting with great force, frequently cause cavitation at the housing wall, thus impairing the capacity of the pump to function properly. According to the invention, this cavitation is avoided by using simple means. An easily established and functionally reliable connection between the two halves of the ring is attained, and in a further embodiment only one fabrication form is required for both ring halves.

In a further embodiment of the pump the stiffness of the hollow cylinder (that is, the wall of the push rod) is increased, and above all the component unit comprising the piston, spring and push rod will not come apart when the pump is mounted on the engine or removed therefrom.

The invention will be better understood and further objects and advantages thereof will become more apparent from the ensuing detailed description of a preferred embodiment taken in conjunction with the drawings.

BRIEF DESCRIPTION OF THE DRAWINGS

Shown in the drawings, all but FIG. 5 in actual size, are.

DESCRIPTION OF THE EXEMPLARY EMBODIMENT

Figure 1:
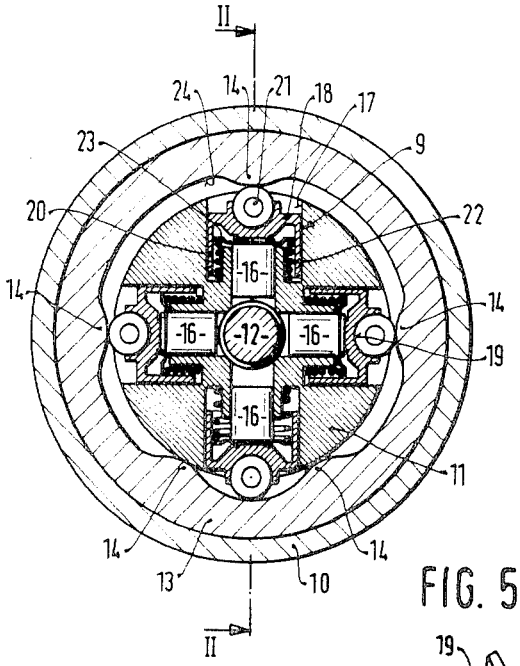
FIG. 1 is a cross-sectional view taken through a fuel injection pump along the line I—I of FIG. 2.
Figure 2:
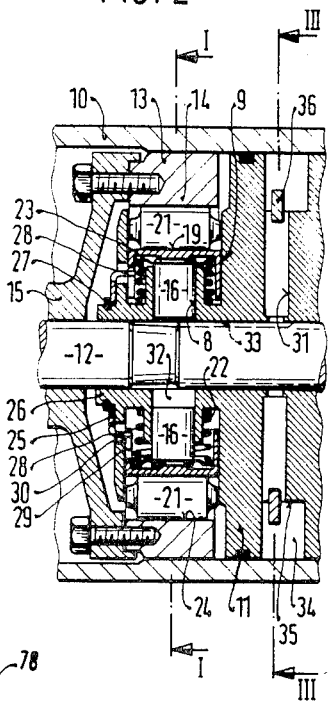
FIG. 2 is an axial cross-sectional view in the supply area of the pump along the line II—II of FIG. 1.

A fuel injection pump of FIGS. 1 and 2 is embodied as a radial piston pump, having a sleeve 11 secured in the housing 10. A slide 12 is supported in the sleeve 11 such that it can be both rotated and axially displaced, driven by a shaft which is not shown. A cam ring 13 has a plurality of inwardly directed cam lobes 14 and is likewise driven by the shaft via a flange 15.

A total of four pistons 16 also move within respective radial bores 8 of the sleeve 11. Four push rods 9 are likewise guided in bores 17 of the sleeve 11 and further include a hollow cylinder 20 and a base 18 having a groove 19. A roller 21 is rotatably supported in this groove 19, and the cross section of the groove 19 is one section of the area of a circle having the same radius as the roller 21, and the depth of the groove 19 is greater than the radius of the section of the area of the circle.

Each of the four push rods 9 is guided in the bore 17 and is disposed coaxially relative to one piston 16. A helical spring 22 is supported at one end on the sleeve 11 and on the other end on a spring plate 23, which is fastened in place in the piston 16. The piston 16 is thereby pressed against the inside of the push rod 9, so that the roller 21 always rests against the race 24 of the cam ring 13.

A fastening ring 25 made of sheet metal and produced by suitable and well-known means is secured to a hub 26 by means of a snap ring 27 and has a plurality of prongs 28 which are directed axially with respect to the slide 12. A slit 29 is disposed parallel to the stroke direction in the end of the hollow cylinder 20 of the push rod 9, and a total of four apertures 30 are disposed in the end face of the sleeve 11 in such a manner that each aperture 30 corresponds with one slit 29, so that a prong 28 of the fastening ring 25 passes through the aperture 30 into the slit 29 and engages it.

A plurality of bores 31 are radially disposed in the sleeve 11 and connect the individual stroke chambers 32 by way of a conduit 33 in the slide 12 with the interior 34 of the pump housing 10. An annular groove 35 open radially toward the outside is cut out of the sleeve 11, centrally with respect to the bores 31, and the diameter of the bores 31 is larger than the width of the annular groove 35. An impact ring 36 is loosely inserted in the annular groove 35.

Figure 3:
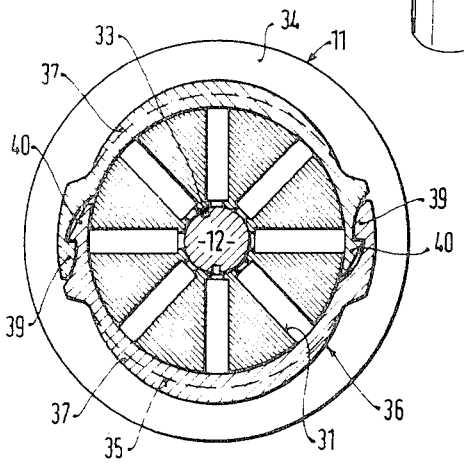
FIG. 3 is a cross-sectional view in the vicinity of the impact ring along the line III—III of FIG. 2.

FIG. 3 shows the impact ring 36 inserted in the annular groove 35 of the sleeve 11; the impact ring 36 is made up of two identical halves 37. Each half has a hook 39 pointing inward and a hook 40 pointing outward, the two being capable of engaging one another in the manner of a detent.

Figure 4:
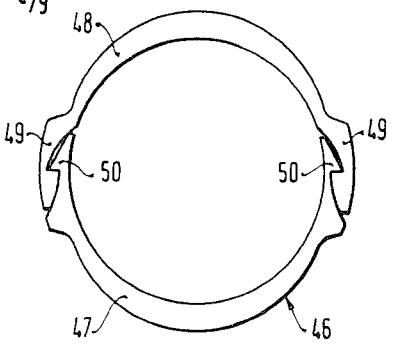
FIG. 4 is an elevational end view of a detail of a second variant of the impact ring.

The impact ring 46 in FIG. 4, shown only in part, comprises two halves 47 and 48. The two hooks 50 of one half 47 point radially outward, and the two hooks 49 of the other half 48 point radially inward, so that again the two halves are capable of engaging one another in the manner of a detent and together they make up the impact ring 46.

Figure 5:
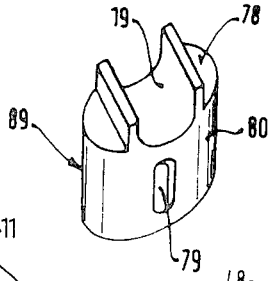
FIG. 5 is a perspective representation of the push rod having an oblong slot.

The push rod 89 in FIG. 5 has the base 78 having the groove 19 and the hollow cylindrical wall 80. Two oblong slots 79 are embodied in the hollow cylindrical wall 80 at two diametrically opposed locations. The longitudinal extension of each oblong slot 79 is disposed in the stroke direction.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. A fuel injection pump having a housing and rotating distributor supported in a sleeve and a first bore including a cam ring, said cam ring having an inwardly directed cam which via a roller and a spring-loaded push rod and relative rotational movement imparts a pumping stroke to a piston radially guided in said first bore, characterized in that each said push rod further includes a base and a hollow cylinder slidably disposed in a second bore, said base and cylinder disposed coaxially relative to said second bore, said second bore arranged to guide said piston, said base further including means for positional fixation of said roller, a spring plate means fastened to said piston, a spring disposed inside said push rod arranged to press said piston radially outwardly via a spring plate, and said sleeve is provided with openings connecting said second bore with an axial face of said sleeve and being adapted to receive prong means, said prong means being supported by a fastening ring connected to said sleeve and further that said prong means extend into guiding means at said cylinder of said push rod.

2. A pump as defined by claim 1, characterized in that said base is provided with a groove approximating a section of the area of a circle and having the same radius as said roller and further that the depth of said groove is greater than the radius of said section of said area of said circle.

3. A pump as defined by claim 1, characterized in that said spring plate means is secured to said piston.

4. A pump as defined by claim 1, characterized in that said means for positional fixation of said roller comprises an oblong slot, said oblong slot having an extension which is disposed parallel to a stroke direction of said piston.

5. A pump as defined by claim 1, characterized in that said annulus comprises a hub means integrated into said sleeve.

6. A pump as defined by claim 5, characterized in that said fastening ring is made of sheet metal and is fabricated from one piece of metal by stamping.

7. A fuel injection pump having a housing and rotating distributor supported in a sleeve and a first bore including a cam ring, said cam ring having an inwardly directed cam which via a roller and a spring-loaded push rod and relative rotational movement imparts a pumping stroke to a piston radially guided in said first bore, characterized in that each said push rod further includes a base and a hollow cylinder slidably disposed in a second bore, said base and cylinder disposed coaxially relative to said second bore, said second bore arranged to guide said piston, said base further including means for positional fixation of said roller, a spring plate means fastened to said piston, a spring disposed inside said push rod arranged to press said piston radially outwardly via a spring plate, and further that a plurality of bores are radially disposed in said sleeve and a plurality of means defining stroke chambers disposed between a plurality of pistons and means extending axially of said pump, said housing further includes a radially outwardly open annular goove, each said bore having a diameter which is larger than the width of said annular groove, and further that a disassemble impact ring comprising plural elements is inserted into said annular groove.

8. A pump as defined by claim 7, characterized in that said plural elements comprising said impact ring are each provided with complemental locking means.

9. A pump as defined by claim 7 or 8, characterized in that each of said complemental locking means is provided with oppositely disposed interengageable hook means.

10. A pump as defined by claim 8, characterized in that each of said complemental locking means comprises semi-circular elements having hook-like end portions of the other half pointing inward.

* * * * *